United States Patent [19]

Duff

[11] 4,398,312

[45] Aug. 16, 1983

[54] SOFA BED OVERDECK ASSEMBLY

[75] Inventor: David Duff, Ponca City, Okla.

[73] Assignee: Hoover Universal, Inc., Ann Arbor, Mich.

[21] Appl. No.: 269,087

[22] Filed: Jun. 2, 1981

[51] Int. Cl.[3] ..... A47C 17/04

[52] U.S. Cl. ..... 5/13; 5/28; 5/29

[58] Field of Search ..... 5/12 R, 13, 29–36

[56] References Cited

U.S. PATENT DOCUMENTS

| | | | |
|---|---|---|---|
| 1,675,883 | 7/1928 | Dyke | 5/13 |
| 2,960,698 | 11/1960 | Castro | 5/13 |
| 3,047,886 | 8/1962 | Thierfelder et al. | 5/13 |
| 3,345,651 | 10/1967 | Fox | 5/13 |
| 3,380,082 | 4/1968 | Mikos | 5/12 R |
| 3,934,281 | 1/1976 | Brindisi | 5/13 |
| 4,236,260 | 12/1980 | Mizelle | 5/13 |
| 4,301,559 | 11/1981 | Geenberghe | 5/13 |

*Primary Examiner*—Ramon S. Britts
*Assistant Examiner*—Michael F. Trettel
*Attorney, Agent, or Firm*—Stephenson and Boller

[57] ABSTRACT

An overdeck assembly for use in a sofa bed mechanism consisting of a plurality of sections foldable between collapsed sofa positions in which sections are stacked vertically and extended bed positions in which the sections extend in substantially horizontal alignment. The overdeck assembly includes a flexible over deck member formed of a polypropylene sheet and secured to the sofa bed mechanism by a tensioning mechanism which allows the deck member to hang loosely below the sofa bed sections in the extended bed position of the mechanism and is stretched across the top of the stacked sections in the sofa position so as to provide a taut uninterrupted support surface for the sofa cushion or cushions.

2 Claims, 7 Drawing Figures

SOFA BED OVERDECK ASSEMBLY

BACKGROUND OF THE INVENTION

Sofa bed mechanisms typically include three sections, namely, a head section, an intermediate section and a foot section. The sections may be extended horizontally to a bed position or folded and stored in a sofa position. Ordinarily, to move the mechanism to the sofa position, the foot section is folded onto the intermediate section and the mechanism is pushed into the furniture which houses the mechanism. The sections also support a mattress, and the head and intermediate sections normally carry a spring or fabric deck which in the sofa position is relatively limp. Thus there is no firm support for the sofa cushion or cushions.

Although these conventional sofa beds have in general been satisfactory, their substantial sizes have dictated that the furniture in which the mechanism is embodied be large in width, that is, large in a direction front of rear of the furniture. This severely limits the types of furniture which may be used. U.S. application Ser. No. 127,919 filed Mar. 6, 1980 and assigned to the assignee of this invention, discloses a compact sofa bed mechanism which is of a shallow dimension in a direction front to rear of the sofa. The foot section is folded onto the intermediate section, which in turn is folded onto the head section so that in the sofa position the foot section is sandwiched between the head and intermediate sections. The sofa bed disclosed therein has been advantageous from the standpoint of width and has proved excellent in operation. However, it lacks a protective deck member, since in the sofa position the intermediate section is on the top of the stack and it is usually unfeasible from a strength standpoint to provide the intermediate section with a fabric grid rather than a spring grid. Even if the intermediate section is provided with a fabric grid, this grid is usually deficient as a deck member in the sofa position, since it will present a loose and discontinuous surface to the sofa cushion or cushions. It is an object of the present invention, therefore, to provide an overdeck assembly adapted to overlie the stacked sections in the sofa position and which forms a taut and continuous support surface for the sofa cushions.

Another disadvantage to conventional sofa beds and to the type disclosed in the aforementioned application is that they are subject to the problem of side-to-side sway in the sofa position. This is, the weight of a user sitting at one side of the sofa can cause the sides of the mechanism to move independently of each other and thus cause the sofa to sink under the user. The provision of cross tubes can solve this problem, but such cross tubes normally interfere with sleeper comfort in the bed position. It is another object of this invention, therefore, to provide an overdeck assembly which provides resistance to side-to-side sway while remaining free from interference with sleeper comfort.

SUMMARY OF THE INVENTION

The overdeck assembly of this invention is particularly adaptable for use on a sofa bed mechanism consisting of three sections, namely, a head section, an intermediate section, and a foot section, these sections being foldable between collapsed sofa positions, in which the sections are in substantially horizontal positions and are stacked vertically, and horizontally extended bed positions in which the sections extend in substantially horizontal alignment. In this type of mechanism, a support frame for the sections is disposed beneath the stacked sections in their sofa positions and a linkage supports the rear section on the support frame so that the sections can readily be swung between their collapsed sofa positions to their extended bed positions.

A plurality of joint assemblies hingedly connect the sections together in order to provide for the necessary unfolding movement in which, when moving the sections from their bed positions to their sofa positions, the foot section is first folded onto the intermediate section, following which the intermediate section, with the foot section thereon, is folded onto the head section so that in the resulting stack, the foot section is sandwiched between the intermediate section and the head section. The joint assemblies also function to maintain the bed frame sections in rigid alignment when in the extended bed positions. Each of the joint assemblies is disposed entirely to one side of the sections that are connected thereby. This avoids the necessity for any connecting tubes running across the sections that might interfere with sleeper comfort when the mechanism is in the bed position.

The invention provides an inproved overdeck assembly for use in multi-section sofa beds. The overdeck assembly consists of an elongated transverse bar secured to the joint assembly connecting the foot and intermediate sections and a flexible deck member having one end secured to the elongated bar and the opposite end secured to the joint assembly connecting the intermediate and head sections. When the mechanism is in the bed position, the deck member hangs below the intermediate section. As the mechanism is folded into the sofa position, the deck member is stretched taut across the intermediate section and overlies the intermediate section in the sofa position. The deck member serves to protect sofa cushions normally placed on top of the stacked sections in the sofa position. The deck member may be formed of a cloth fabric or a formed plastic material, such as polypropylene, and provides a taut and continuous surface for the sofa cushions.

The elongated bar of the overdeck assembly is disposed on the underside of the mechanism and extends between corresponding sides of the joint assembly connecting the foot and intermediate sections. When the mechanism is in the bed position, the bar is located sufficiently below the sleeping surface so as not to interfere with sleeper comfort. In both the bed position and the sofa position, the bar ensures against independent movement of corresponding sides of the joint assembly and thus enhances the overall rigidity of the mechanism.

By virtue of the use of a three section mechanism, the supporting frame and the stacked sections can be constructed of a relatively narrow width, namely, a very shallow dimension in a direction front to rear of the sofa. Furthermore, by virtue of the particular joint assemblies utilized in the mechanism of this invention, the sections can be relatively tightly folded so that the stacked sections and the supporting frame present a relatively low profile in the sofa position of the mechanism. The result is a compact mechanism which can readily be incorporated in sofa furniture of widely varying designs without any requirement for a wide sofa frame to accommodate the mechanism and without any requirement for a storage space at the rear of the seating area on the sofa. The overdeck assembly of this invention achieves the desired objectives of protecting the sofa cushions and providing resistance to side-to-side sway while enhancing, rather than interfering with, sleeper comfort.

The sofa bed mechanism of this invention thus achieves desirable objectives in a dual purpose furniture item that has traditionally been difficult to construct and assemble so that it is satisfactory both for seating and sleeping purposes.

Further objects, features and advantages of this invention will become apparent from a consideration of the following description, the appended claims and the accompanying drawing in which:

FIGS. 1–5, inclusive, are end views of the sofa bed mechanism of this invention, illustrating the mechanism in successive positions as it is moved from its extended bed position shown in FIG. 1 to its collapsed sofa position shown in FIG. 5, an outline of the sofa frame being shown in FIGS. 1 and 2, and the mattress being eliminated from FIGS. 4 and 5 for the purpose of clarity.

Figure 1:
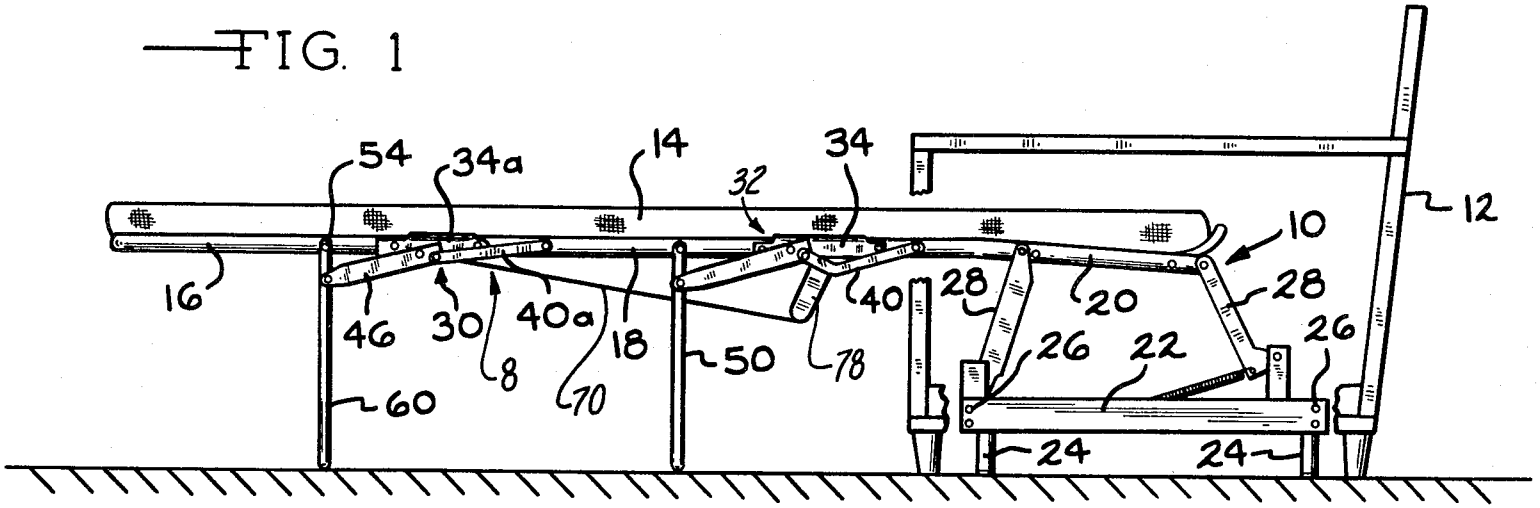

With reference to the drawing, the overdeck assembly of this invention, indicated generally at 8, is illustrated in FIG. 1 in assembly relation with a sofa bed mechanism indicated at 10. The mechanism 10 is shown in its bed forming position in which it extends forwardly from a sofa frame 12 and provides a firm support for a generally horizontally disposed mattress 14. The mechanism 10 consists of three relatively foldable metal framework sections, namely, a front section 16, an intermediate section 18, and a head section 20. The mechanism also includes a support frame 22 having legs 24 that enable it to be floor supported within the frame 12 and having mounted bolts 26 which enable it to be secured to the ends of the frame 12 so that the frames 12 and 22 will be maintained in fixed relative positions. Support links 28 pivotally support the head section 20 of the mechanism 10 on the frame 22 so that the section 20 can readily be swung between its bed position shown in FIG. 1 and its sofa position shown in FIG. 5.

The mechanism 10 also includes a pair of front hinge assemblies 30 disposed on opposite sides of the foot and intermediate sections 16 and 18, and only one of which is shown in FIG. 1. The mechanism 10 further includes a pair of rear hinge assemblies 32 which hingedly connect the intermediate and head sections 18 and 20 and are disposed on opposite sides thereof, only one assembly 32 being shown in FIG. 1. Since the hinge assemblies 30 and 32 are substantially identical, only the hinge assembly 32 will be described in detail hereinafter. Like numerals indicate like parts in the assemblies 30 and 32 and the suffix "a" refers to parts on the front assembly 30.

Figure 2:
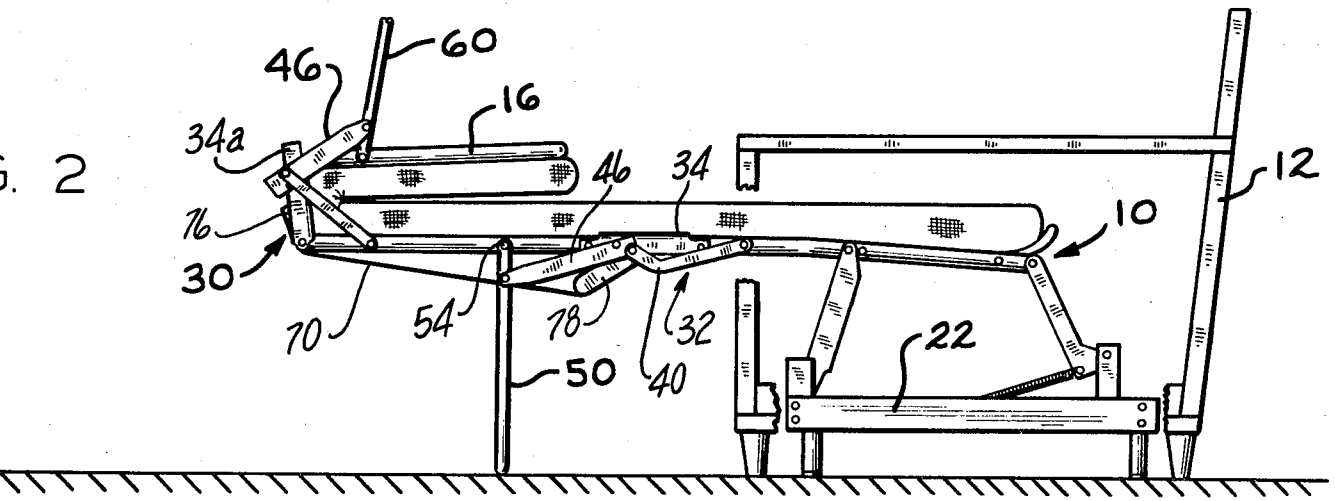

Referring to FIG. 2, the hinge assembly 32 includes a hinge bar 34 which is pivotally connected at its front to the intermediate section 18 and at its rear end is pivotally connected to the head section 20. A control link 40 is pivotally connected at one end to the section 20 and at its opposite end to one end of a locking link 46. The opposite end of the link 46 is pivotally connected to a support leg 50 which, in the bed position of the section 18, provides a floor support for the section 18. The leg 50 is of conventional U-shape being connected at its end by pivot pins 54, only one of which is shown, to the frame 18. A similar support leg 60 is provided at the front joint assembly 30. The locking link 46 is pivotally connected to the hinge bar 34.

It is to be noted that the joint assemblies 32 are disposed entirely to the sides of the connected sections 18 and 20, thereby avoiding the necessity for any connecting tubes or the like running side to side between the section 18 and the sections 20 at positions below the mattress 14. Such tubes are very undesirable from the standpoint of user comfort when the mattress 14 is in its bed position.

Figure 5:
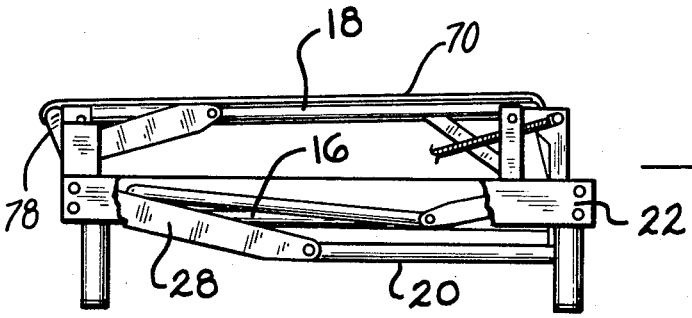

In the operation of the mechanism 10, assume that the sections 16, 18 and 20 are in their horizontally extended bed positions shown in FIG. 1 and that it is desired to fold the sections 16, 18 and 20 to the collapsed sofa position shown in FIG. 5. The section 16 is first moved upwardly and rearwardly to a folded position with respect to the intermediate section 18, as illustrated in FIG. 2. The U-shape leg 60 is then moved clockwise from its FIG. 2 position to an over-center position so as to lock the joint assemblies 30 in positions in which the sections 16 and 18 are maintained in folded positions.

Figure 3:
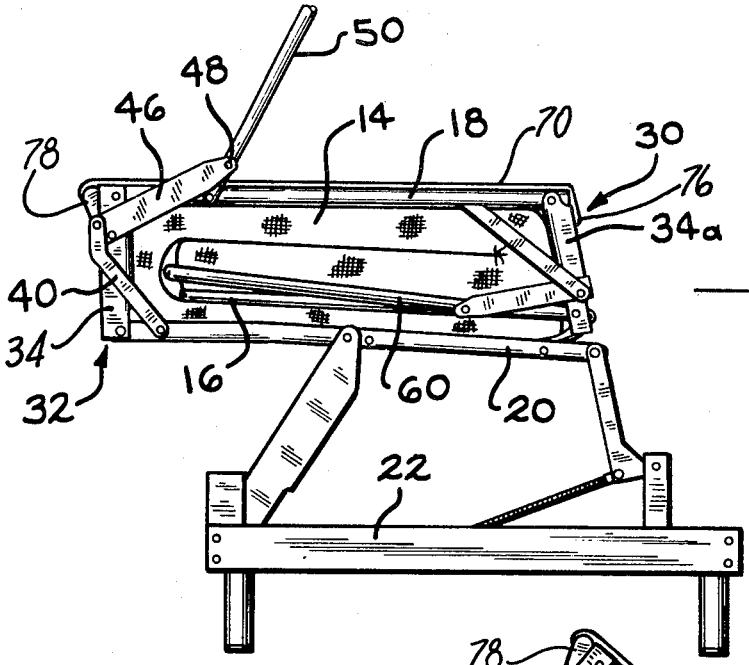
Figure 4:
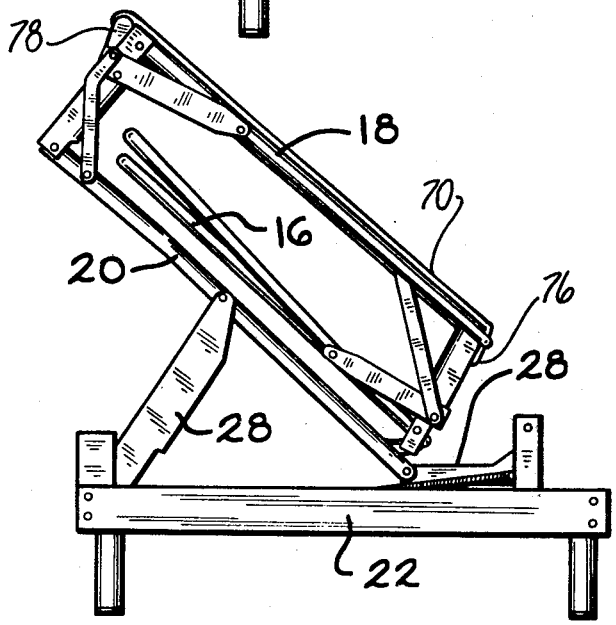

The intermediate section 18, with the foot section 16 folded over on it, as shown in FIG. 2, is then manually swung upwardly and rearwardly to its folded position on the rear section 20. This is illustrated in FIG. 3 in which it is shown that the foot section 16 is disposed in a sandwich between the sections 18 and 20. With the U-shape supporting leg 50 extending upwardly, as shown in FIG. 3, the leg 50 is then swung downwardly to the overcenter position to lock the section 18 in its folded position on the section 20. The folded sections 16, 18 and 20 are then moved downwardly through the successive positions illustrated in FIGS. 4 and 5 to the fully folded sofa position illustrated in FIG. 5.

In the folded positions of the sections 16, 18 and 20 shown in FIG. 5, it is seen that the sections are generally horizontal and are in a superposed relation. When taken together with the frame 22, the mechanism sections form a compact generally rectangular profile when viewed from the end. By virtue of the fact that the mattress 14 is folded into three sections corresponding to the sections 16, 18 and 20, the rectangular profile shown in FIG. 5 is very shallow in a direction front to rear of the sofa frame 12. This is very desirable from the standpoint of the furniture manufacturer because it enables the furniture manufacturer to make relatively shallow frames 12 and assemble those frames 12 with satisfactory mechanisms 10.

Figure 6:
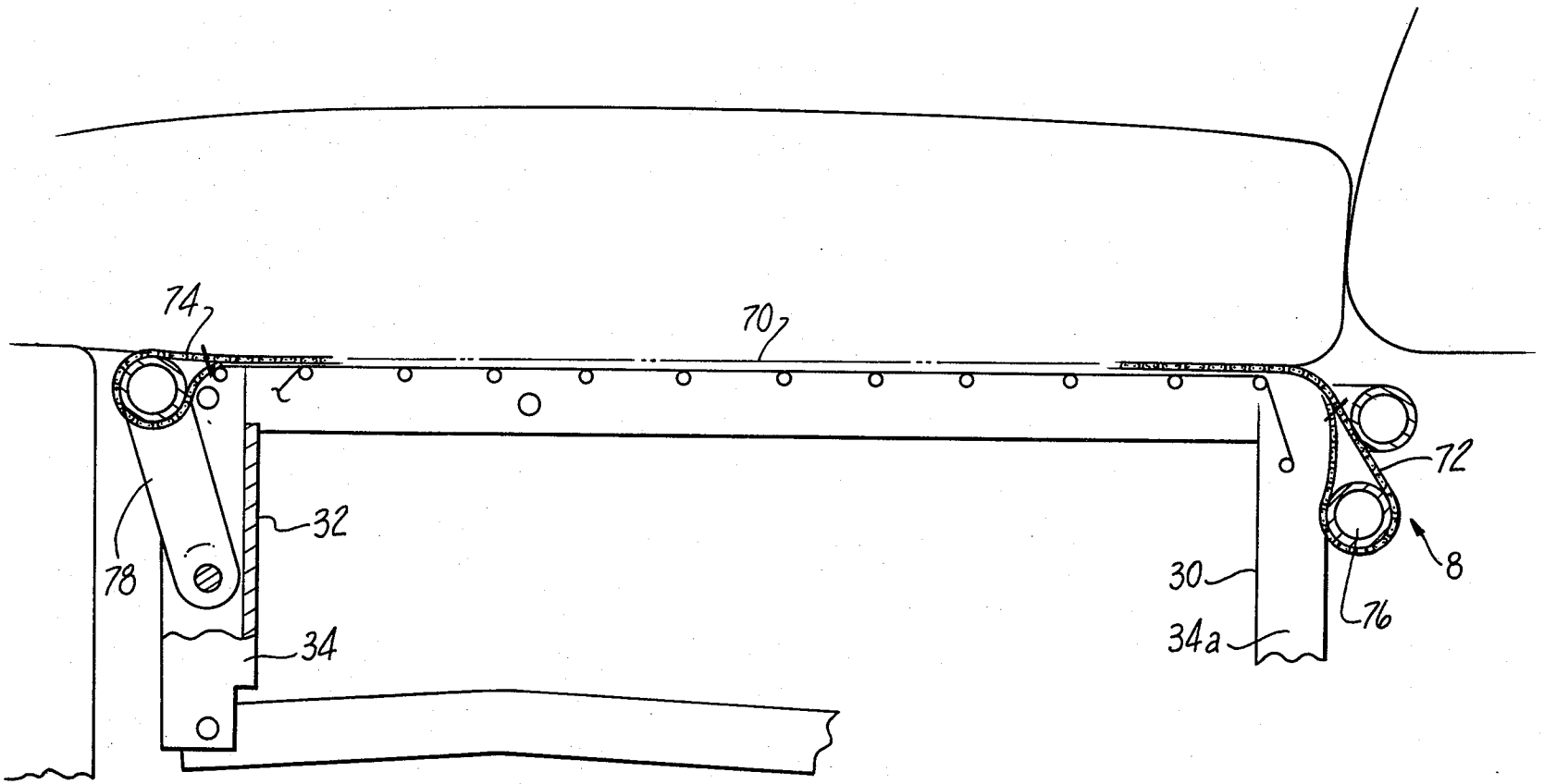
FIG. 6 is an enlarged fragmentary side view of the sofa bed mechanism and the overdeck assembly of this invention, showing the sofa bed mechanism in its sofa position, with portions of the joint assembly broken away for clarity.

Referring to FIG. 6, the overdeck assembly 8 of this invention is shown with the sofa bed mechanism in the sofa position. The overdeck assembly 8 includes a flexible deck member 70 which is stitched at its ends to form a pair of loops hereinafter referred to as a first end portion 72 and an opposite end portion 74. The deck member 70 consists of a sheet of fabric formed of fibers of suitable strength, such as heat treated polypropylene. The deck member 70 has a predetermined width between the end portions 72 and 74 for a purpose to appear presently, and a length between the sides of the mechanism 10 sufficient to substantially cover the intermediate section 18 when the mechanism 10 is in the sofa position.

Figure 7:
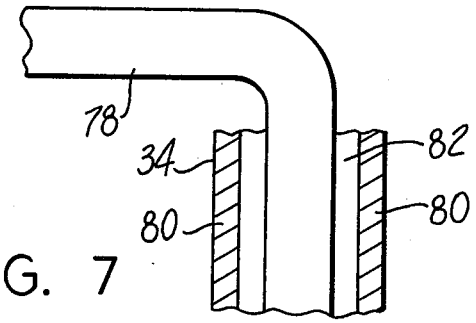
FIG. 7 is a fragmentary sectional view of the joint assembly connecting the head and intermediate sections of the sofa mechanism, shown in the sofa position and showing the U-shaped arm connected thereto.

The overdeck assembly 8 further includes an elongated bar 76 which is secured to the hinge bars 34*a* on the front joint assembly 30. As seen in FIG. 1, the elongated bar 76 is secured to the undersides of the hinge bars 34*a*, only one of which is shown in FIG. 1, and extends between the hinge bars 34*a*. The first end portion 72 of the deck member 70 is secured to the elongated bar 76. The opposite end 74 of the deck member 70 is secured to a U-shaped arm 78 which is pivotally mounted on the hinge bars 34 of the rear joint assembly 32. As seen in FIG. 7, each of the hinge bars comprises a pair of parallel legs 80 and a connecting web 82 and provides an open end which permits rotation of the U-shaped arm 78. The arm 78 extends between the sides of the mechanism 10 and is connected at each of its ends to a hinge bar 34.

When the mechanism 10 is in the extended bed position, as seen in FIG. 1, the deck member 70 hangs loosely below the intermediate section 18. As the mechanism 10 is moved toward its sofa position (FIGS. 2–5), the deck member is stretched around the corners of the hinge bars 34*a* so that when the mechanism 10 is in its sofa position (FIG. 6), the deck member 70 extends across the top of the intermediate section 18 and thereby protects the stacked sections. The deck member 70 has a predetermined width to ensure that it hangs loosely in the bed position and stretches tightly in the sofa position.

The elongated bar 76 serves at least two functions. First, the bar 76 serves to support and position the deck member 70. Second, the bar 76 provides resistance to sideways sway of the mechanism 10. Sideways sway is caused by independent relative movement of the hinge bars 34*a* at opposite sides of the mechanism 10 due to an uneven weight distribution on the mattress 14 (FIG. 1) or on the sofa cushions (FIG. 6). The elongated bar 76 of this invention serves to connect the bars 34*a* and thereby prevent such independent relative movement. It is to be noted that the elongated bar 76 performs these functions without interfering with user comfort since, in both the bed position and the sofa position, it is disposed sufficiently below the surface exposed to the user.

The invention thus provides an improved overdeck assembly 8 adaptable for use in sofa bed mechanisms 10 which are substantially shallow in width. It provides a deck member 70 which presents a taut and continuous surface to the sofa cushions in the sofa position and an elongated bar 76 which supports and positions the deck member 70 and which provides resistance to sideways sway of the mechanism 10. The overdeck assembly is simple and inexpensive to construct and assemble, and is readily adaptable for use on various types of multi-section sofa bed mechanisms.

What is claimed is:

1. In a sofa bed assembly, a mechanism comprising a plurality of sections including in succession a head section, an intermediate section, and a foot section, said sections being foldable between collapsed sofa positions in which the sections are in substantially horizontal superposed relation and a horizontally extended bed position in which said sections extend in substantially horizontal alignment, a support frame for said sections disposed beneath said superposed sections in said sofa positions, linkage means pivotally supporting said head section on said support frame, connecting joint means pivotally supporting said foot section on said intermediate section and pivotally supporting said intermediate section on said head section, each said joint means including at each side of said mechanism a hinge bar pivotally connected at its ends to the connected sections, and an overdeck assembly comprising an elongated bar secured to the one of said joint means which supports said foot section on said intermediate section and extending transversely of said sections, a flexible deck member having a first end portion secured to said elongated bar and an opposite end portion secured to another joint means which supports said intermediate section on said head section, said deck member being disposed below said intermediate section in said bed position and having a predetermined width between said end portions so that when said sections are folded into the sofa position said deck member is stretched across said intermediate section and overlies said intermediate section.

2. A sofa bed mechanism according to claim 1, wherein said elongated bar is secured to and extends between the hinge bars at each side of the mechanism associated with said one joint assembly, said elongated bar being disposed below said sections in said bed position.

* * * * *